US012000217B2

(12) United States Patent
Sihler et al.

(10) Patent No.: US 12,000,217 B2
(45) Date of Patent: Jun. 4, 2024

(54) SHOCK AND VIBRATION REDUCTION IN DOWNHOLE TOOLS

(71) Applicant: Schlumberger Technology Corporation, Sugar Land, TX (US)

(72) Inventors: Joachim Sihler, Cambridge (GB); Hutaib Babat, Dammam (SA); Taihei Ueno, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/341,165

(22) Filed: Jun. 26, 2023

(65) Prior Publication Data

US 2023/0332473 A1 Oct. 19, 2023

Related U.S. Application Data

(62) Division of application No. 16/943,466, filed on Jul. 30, 2020, now Pat. No. 11,732,534.

(60) Provisional application No. 62/881,040, filed on Jul. 31, 2019.

(51) Int. Cl.

| | |
|---|---|
| ***E21B 17/07*** | (2006.01) |
| ***E21B 17/10*** | (2006.01) |
| *E21B 17/00* | (2006.01) |

(52) U.S. Cl.

CPC ..... *E21B 17/07* (2013.01); *E21B 17/1014* (2013.01); *E21B 17/00* (2013.01); *E21B 17/10* (2013.01)

(58) Field of Classification Search

CPC ..... E21B 17/00; E21B 17/07; E21B 17/10; E21B 17/1014

See application file for complete search history.

(56) References Cited

U.S. PATENT DOCUMENTS

| | | | | |
|---|---|---|---|---|
| 5,485,745 | A | 1/1996 | Rademaker et al. | |
| 5,706,894 | A * | 1/1998 | Hawkins, III | E21B 17/10 166/208 |
| 6,311,792 | B1 * | 11/2001 | Scott | E21B 19/10 166/85.1 |
| 2009/0025982 | A1 | 1/2009 | Hall | |

(Continued)

OTHER PUBLICATIONS

Schlumberger, Product Brochure, "Multifunction LWD service—Ecoscope", Document No. 17-DR-272647, 2017, 3 pages.

*Primary Examiner* — Yong-Suk (Philip) Ro

(74) *Attorney, Agent, or Firm* — Jeffrey D. Frantz

(57) ABSTRACT

Systems, methods, tools, and kits are used to reducing shocks and vibrations in tools, including downhole drilling tools. In at least some embodiments, shock and vibration reduction can be enhanced within tools that include an annular chassis within a collar. Existing locations where a gap exists are identified, and clamps, alignment features, joints, or other components can be modified or included to reduce the gap between the chassis and the collar. This includes a tool in which the chassis includes a flow tube or other tool with an axis that is offset from the axis of the chassis. Minimizing the gap can include providing three-point contact, which stabilizes the internal component within the collar. In a downhole environment, a downhole tool that includes the collar and chassis can perform a drilling or other downhole operation, and the internal vibration within the collar is reduced.

7 Claims, 11 Drawing Sheets

(56) References Cited

U.S. PATENT DOCUMENTS

2018/0305985 A1* 10/2018 Steine ..... E21B 17/1078
2021/0032941 A1 2/2021 Sihler

* cited by examiner

SHOCK AND VIBRATION REDUCTION IN DOWNHOLE TOOLS

CROSS-REFERENCE TO RELATED APPLICATIONS

This application is a divisional of U.S. patent application Ser. No. 16/943,466, filed on Jul. 30, 2020, which claims the benefit of, and priority to, U.S. Patent Application No. 62/881,040, filed Jul. 31, 2019. Each of the above applications is expressly incorporated herein by reference in its entirety.

BACKGROUND

During a downhole drilling process, drilling tools (including a BHA that may include measurement or logging tools) are subjected to a certain amount of abuse in the form of shock, vibration, and impact. The amount of shock, vibration, and impact damage is a function of the BHA and tool design, as well as the drilling parameters (e.g., rotational speed, weight-on bit (WOB), drilling fluid properties, etc.). If operators push the envelope to maximize rate of penetration (ROP), the result will be that a tool will eventually fail unless the tool is pulled from the wellbore or some other remedial action takes place prior to failure.

Reliability is an expression of the durability, robustness, and resistance of a tool to failure when in these harsh environments. Ultimately, reliability is related to the time a tool can withstand the environment before failure. One metric for this can include mean time between failure (MTBF), and tools with higher MTBF or other reliability metrics generally have a design or application that results in the tool being less prone to failure than tools with lower MDBF.

SUMMARY

Embodiments of the present disclosure relate to systems, methods, and tools for reducing shocks and vibrations in downhole drilling tools. In at least some embodiments, shock and vibration reduction can be enhanced by using annular style chasses and minimizing the gap between the chassis and the collar.

In an example method or system, a series of working steps, special tooling, and replacement parts are used in connection with an existing drilling tool. The method and system aim to reduce the amount of rework of the drilling tools in the field while still achieving maximum effect of shock reduction. Hence, some embodiments of the present disclosure also include a kit that can be deployed to field locations. The kit may include mechanical components that can be used to upgrade one or more tools of the existing fleet during the next service, thereby avoiding re-machining, scrapping of parts, or replacement of large and expensive parts such as a tubular chassis.

In some example embodiments, a tool includes a collar, a chassis at least partially within the collar, and a tube or rod at least partially within the chassis. A clamp may be fitted at least partially around the tube or rod and secured to the chassis. Optionally, the claim includes one, two, or more bumper pads on the outer surface thereof. Such pads may be fixed, or may be adjustable as to axial, circumferential, or radial position. In at least some embodiments, the bumper pads and an outer surface of the clamp providing three or more points of support between the chassis and an inner surface of the collar.

Where bumper pads are used, they may be placed or formed directly on the chassis, or may be removable relative thereto. When secured to the chassis, they may be placed on the outer surface, including within a pocket in the outer surface.

A chassis of the present disclosure may include a void opposite the clamp. In such case, a second clamp may be secured to the collar opposite the first clamp. The second clamp may include one or more bumper pads on the outer surface thereof. Within a void in the chassis there may be a tool such as a flow tube, another tube or rod, or a pulse neutron generator. When first and second clamps are used, at least four points of support may be provided between the chassis and an inner surface of the collar. Such clamps may also be axially aligned or offset. In at least some embodiments, the chassis has a longitudinal axis that is misaligned with the longitudinal axis of the collar, the tube or rod has a longitudinal axis that is misaligned with the longitudinal axis of the chassis, or both.

Other embodiments of the present disclosure relate to a jointed tool that includes first and second chassis portions that are coupled at a joint. At least the first chassis portion includes one or more pockets and one or more fasteners are within the one or more pockets and used to couple the first and second chassis portions. One or more bumper pads are also in the one or more pockets and extend radially beyond an outer surface of the first chassis portion. A collar may be positioned around the first and second chassis portions. The first and second chassis portions and the one or more bumper pads can provide three or more points of support between the collar and the first and second chassis portions. In at least some of these embodiments, a tube or rod is at least partially within the first chassis portion, the second chassis portion, or the first and second chassis portions.

Other embodiments relate to a tool that includes a collar and a chassis within the collar. An alignment feature that angularly aligns the chassis and the collar may also be used and may reduce a gap between an outer surface of the chassis and an inner surface of the collar. The alignment feature optionally includes one or more springs or other biasing members that bias at least a portion of the outer surface of the chassis into contact with the inner surface of the collar. An optional plunger may be radially moveable relative to the chassis and compress the one or more biasing members to press the chassis against the collar.

In some embodiments, an alignment feature may be used in connection with one or more threaded components that move radially relative to the chassis. The one or more threaded components may move radially inwardly and contact a pocket wall to thereby press the alignment key against the inner surface of the collar. An opening can be defined in a threaded component or between or to the side of a threaded components, and a plug may be positioned within the collar and the opening.

Methods of some embodiments of the present disclosure include methods for stabilizing an internal assembly and include assessing an existing tool design where the tool includes an external component at least partially around an internal component. One or more locations may be identified where a gap exists between an outer surface of the internal component and an inner surface of the external component. One or more gap reduction components can be secured to the external component, the internal component, or both, which create three or more points of support having a reduced gap. The gap reduction component can include a flow tube clamp, joint bumper pads, or an alignment pin with a locking feature. Kits may also be provided to stabilize an internal assembly, and can include a clamp, bumper pads, alignment tools, or other gap reduction components.

According to another embodiment, an adjustment tool is provided for a gap reduction assembly. The adjustment tool includes a lead ring, a follower ring coupled to the lead ring, and a plurality of micrometers coupled to the lead ring or the follow ring. The plurality of micrometers can include one or more first micrometers arranged and positioned to measure a pocket depth, and one or more second micrometers arranged and positioned to measure a bumper pad outer diameter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, drawings of mechanical elements that are not identified as schematic should be considered as being to scale for some embodiments of the present disclosure, but are not limited to the illustrated scale. Understanding that the drawings depict some example embodiments, the embodiments will be described and explained with additional specificity and detail through the use of the accompanying drawings in which:

FIG. 1-2 is a cross-sectional view of the stabilized assembly of FIG. 1-1 with a port plug, according to another embodiment of the present disclosure.

FIG. 2 is a perspective view of a drilling tool such as a logging-while-drilling tool that includes a flow tube, flow tube clamp, and a go/no-go gauge, according to some embodiments of the present disclosure.

FIGS. 3-1 and 3-2 are perspective views of clamps used to secure flow tubes, according to some embodiments of the present disclosure.

FIGS. 5-1 and 5-2 are perspective and cross-sectional views of a ring gauge with adjustable pads and micrometers that may be used to adjust the pads, according to some embodiments of the present disclosure.

FIG. 6-1 is a perspective view of another embodiment of a clamp for supporting a flow tube.

FIG. 6-2 is a schematic view of the point supports for the clamp of FIG. 6-1.

FIG. 7-1 is a perspective view of pads within pockets in a chassis or body joint, according to another embodiment of the present disclosure.

FIG. 7-2 is a schematic view of the point supports for the joint of FIG. 7-1.

DETAILED DESCRIPTION

Figure 1:
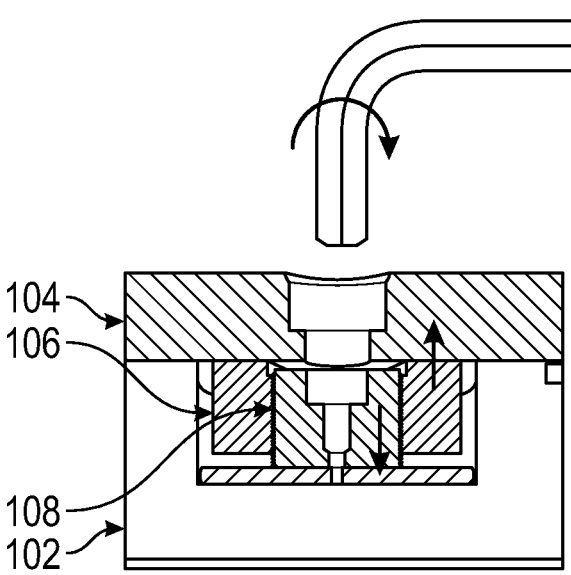
FIG. 1-1 is a cross-sectional view of a stabilized assembly including threaded components to secure a collar to a chassis and provide two-point support, according to an embodiment of the present disclosure.

Embodiments of the present disclosure relate to systems and tools with increased reliability and decreased susceptibility to one or more of shock or vibration. In some embodiments, methods include modifying or manufacturing tools that have increased reliability and decreased shock and vibration. In still other embodiments, a kit is provided for retrofitting existing tools to reduce shock and vibration.

Within a drilling BHA, the intensity of the drilling shocks and vibrations can be a function of the BHA design, while the drilling parameters may also provoke higher shock and vibration (S&V). Additionally, however, the internal architecture of particular tools can also have a strong influence on how damaging shocks and vibrations propagate to the sensitive elements where failure occurs. For instance, some sensitive elements include electronic boards, detector tubes, connectors, threads, harnesses, weldments, ports, locations of stress concentrations, and the like.

An example drilling architecture can be referred to as an "annular chassis" design, where some or all sensitive functional components are arranged toward or on the outer diameter (OD) of a rod, cylinder, or tube. This rod, cylinder, or tube operates as the chassis as it carries these components. Such components may be directly on the outer surface, may be positioned through the outer wall of a tubular component (e.g., a port extending through the wall), or may be on the inside wall of a tubular chassis. A tubular chassis typically has a flow bore thru the center to enable the circulation of the drilling mud. Due to space constraints-particularly in smaller downhole tools-tools may have a "flow tube" to facilitate fluid flow. The flow tube of some downhole tools is arranged off-center relative to the chassis in order to make room for large functional components which otherwise may not fit around a central flow bore. For instance, radioactive receiver tubes on/off valves, and other components may be positioned around a flow tube. Some illustrative downhole tools include the ADNVISION, ARCVISION, DIGISCOPE, ECOSCOPE, GEOSPHERE, GEOVISION, IRISPHERE, MICROSCOPE, NEOSCOPE, OMNISPHERE, OPTID- RILL, PERISCOPE, POWERDRIVE, PROVISION, RHINO, SEISMICVISION, SONICSCOPE, SONICVISION, SPECTRASPHERE, STETHOSCOPE, and TELESCOPE tools available from Schlumberger in Houston, Texas, although embodiments of the present disclosure may be used in connection with tools of other companies.

Within tools with an annular chassis design, there may be a gap between the chassis OD and the collar inner diameter (ID). When the tool is subject to shocks and vibrations, the gap can allow steel-to-steel internal impact to occur between the chassis and the collar. From these impacts, the shocks on the chassis may be higher than the shocks on the collar, and can have a higher frequency, which may end up exciting smaller structures with a higher natural frequency (e.g., boards or other elements). The term "shock transmissibility" can be used to express the amplitude ratio between the shocks on the chassis and the collar, or the ratio between the shocks on the chassis and the boards, and tools can be designed for increased or maximum transmissibility between these elements.

In general, the cap can be seen as influencing the transmissibility of the shocks from the collar to the chassis, although quantifying this parameter for relation to the structural response of the tool is difficult. Assuming that if the gap was in fact zero-even if not achievable in practice—the internal impacts may not exist. Hence, as the gap increases, the impacts should theoretically be more significant. Conversely, minimizing the gap should reduce impact severity. The gaps used in the tools today varies depending on the tolerances, tool components, design, function, and other factors. In one tool, for instance, the collar may be sized to be to 124+0.1/−0) mm, and the chassis sized to 123.75+0.1/−0.5 mm. This means that there could be a gap anywhere from 150 to 850 microns, leaving the potential for internal motion and impacts. Minimizing the gap is not easy, however, as it means accurately matching the ID of the bore in the collar with the effective OD of the chassis within the tens of microns.

While the gap between the chassis and the collar can influence the effects external shocks have on the internal shocks within the tool assembly, no detailed, systematic measurements and investigations are known to have been performed to relate the actual gap of a specific collar and chassis combination with the detailed shock response. This may have to do with the fact that measuring the actual gap along the entire chassis is quite difficult, including because the same gap may not exist everywhere as the parts are subject to machining tolerances. While measuring the chassis OD may be doable, measuring the ID of the collar continuously with micron accuracy over extended lengths (e.g., 5-10 m) is not an easy task. Hence it is likely that this gap—albeit important—has never been looked into in detail.

Understanding the role of the gap, it can be seen that controlling the clearance between the collar and chassis to the lowest permissible value to minimize the transmissibility of shocks is desirable. However, this comes with increased manufacturing costs of requiring special tooling to maintain tight tolerances over lengths that can exceed 5, 7, 8, or even 10 m on the collar ID and chassis OD. Additionally, if the components are assembled by sliding the chassis within the collar, the close tolerances should still allow for ease of assembly.

In some embodiments, rings around the chassis may be used for shock reduction. For instance, polymers (e.g., polytetrafluoroethylene (PTFE), polyether ether ketone (PEEK), ultra-high-molecular-weight polyethylene (UHMWPE), etc.) may be fitted around the chassis. Instead of reducing the gap, such rings maintain the gap between the chassis and collar and instead rely on the ring providing a softer or dampened impact and thus a reduction in internal shock levels.

Figures 1, 2:
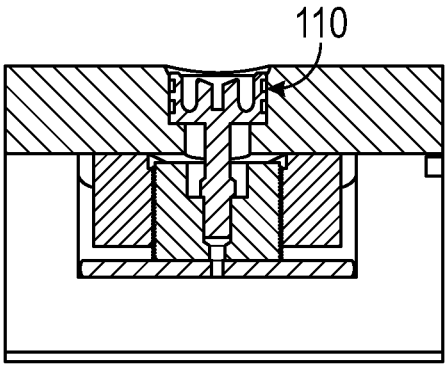
Figure 2:
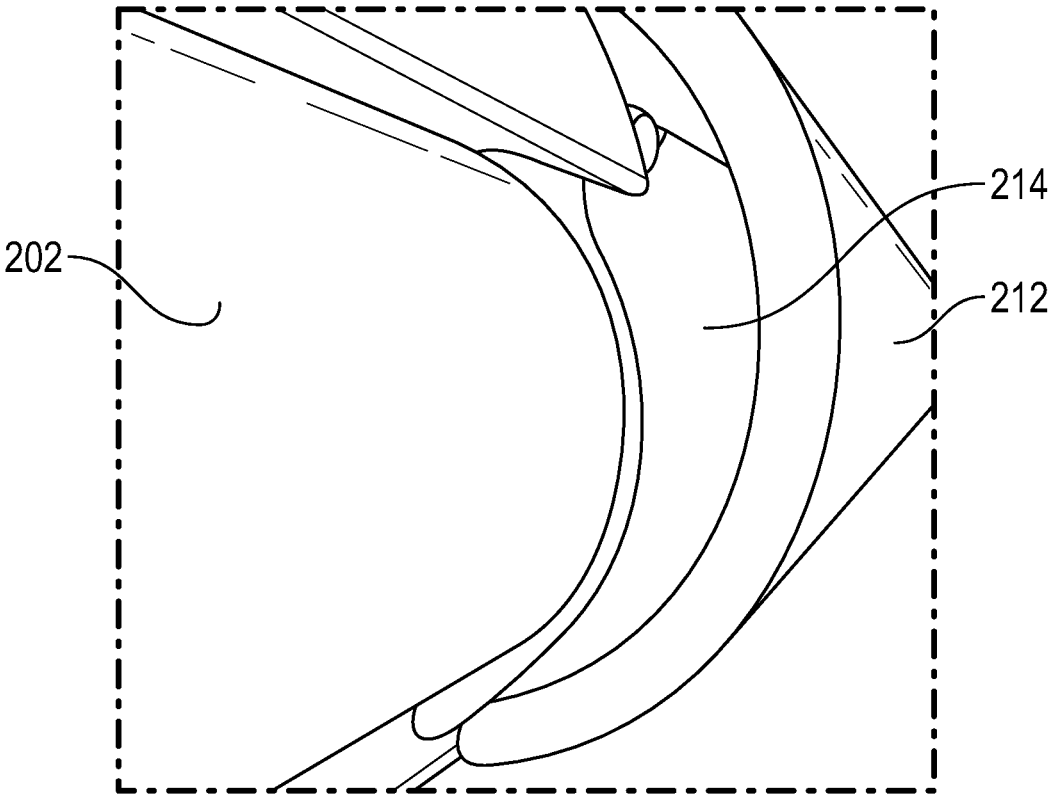

In other embodiments, the relative motion between the collar and the chassis is minimized or potentially prevented by "jamming" or fixing them to one another radially. For instance, as shown in FIGS. 1-1 and 1-2, this can include pushing or pulling the chassis 102 in one direction via torqueing radially positioned, threaded components 106, 108 such as set screws or port plugs 110. These components push or pull once screwed and hence push/pull the collar 104 and the chassis against each other to reduce or potentially eliminate the relative axial and radial movement. This creates a two point support, where the first point is the threaded component 106, 108, and the second point is the touch point between chassis 102 and collar 104 at an opposite position 180° from the threaded component 106, 108.

It is proposed that eliminating relative movement between chassis and collar is beneficial for improving shock performance. However, for existing tools this can involve significant modifications to the collar and chassis and the creation of new port holes, slots, and the like, which can increase cost due to re-work of the existing tool, but also because each port hole can create another site at risk of cracking, and therefore a risk of the tool being lost in hole (LIH).

Some embodiments of the present disclosure relate to kits, methods, systems, and tools for re-working existing tools in a way that does not materially increase the sites at risk of cracking or failing. Embodiments used herein may be described in reference to a logging-while-drilling (LWD) tool, although application of these embodiments can be applied analogously to other drilling tools, whether new or existing. Examples of other tools include reamers, motors, rotary steerable tools, measurement-while-drilling tools, telemetry tools, jars, remedial tools, drill bits, other tools, or combinations of the foregoing. In some embodiments, the tool may include an annular chassis design and an off-center flow tube. Optionally, formation evaluation, sampling, drilling dynamics, or other sensing or measurement tools, or drilling tools (e.g., cutting tools, steering tools, etc.) may be integrated into the same tool. Hence, the tool may have a number of electronic boards, switches, valves, ports, and the like densely packed onto the chassis. Electronic boards in particular may have board failures that could appear to be related to circuit design, component selection, or firmware, yet instead be caused by mechanically induced shock or vibration. Therefore, implementing shock and vibration reducing techniques could in further improving the reliability of such tools.

An example method of the present disclosure includes assessing the existing tool design and identifying opportunities to change existing, or to add new parts, to effectively control a chassis OD, collar ID, or both, and potentially to do so using least a "three-point support," although four-point, five-point, or even continuous support may be used. In one embodiment, a tool includes clamps that hold a flow tube in place and improvements can be made to such claims. To illustrate this, FIG. 2 shows a situation where a go/no-go gauge 212 is passed over the chassis 202. What can be seen here is that there is space between a flow tube clamp 214 and the go/no-go gauge 212. For explanation, the go/no-go gauge 212 is optionally used to simulate a chassis insertion into a collar, and it is run over the chassis 202 to ensure that no part of the chassis 202 or the components attached thereto is bigger that what would fit into the collar (e.g, wires being in danger of being sheared off during the insertion). The picture in FIG. 2 reveals that there is a potential for extra design space to fit features that enhance diameter and gap control. Additionally, while a single flow tube clamp 214 is shown, additional clamps may be provided along the length of the tool (e.g., every 2-3 ft (600-900 mm)), to provide a reasonable length of unsupported chassis between supports.

Figures 1, 3:
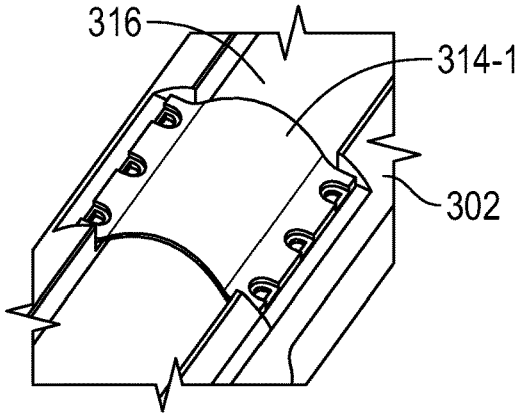
Figures 2, 3:
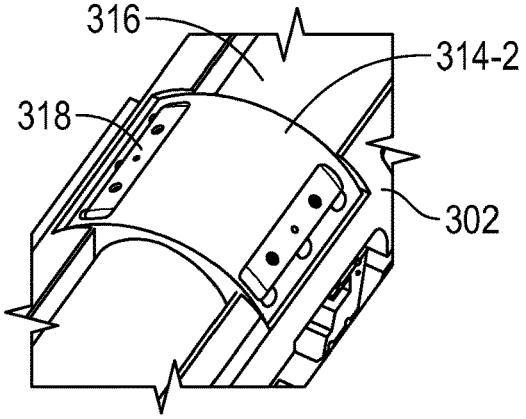

In another step, a replacement or additional part is created. For instance, FIG. 3-1 illustrates an example flow tube clamp 314-1 and FIG. 3-2 illustrates a replacement flow tube clamp 314-2. Optionally, the replacement flow tube clamp 314-2 may be fitted without modification to the chassis 302. As shown in FIGS. 3-1 and 3-2, the replacement flow tube clamp 314-2 may be thicker (generally or in one or more locations). In some embodiments, the replacement flow tube clamp 314-2 is more rigid. As also seen in FIG. 3-2, the replacement flow tube clamp 314-2 may also or instead include one or more bumper pads 318. As used herein, the term "bumper pad" is used to describe contact elements that can be added (or integrally formed) in a component to enhance contact and reduce a gap at discrete positions. The term is therefore synonymous with a contact pad, support surface, or the like. Further, while an element may be referred to as a "block" or "pad", the difference is meant to highlight that the element may have a relatively larger thickness (i.e., a block) or a relatively thinner thickness (i.e., a pad); however, the term "pad" is intended to include both pads and blocks unless otherwise specified.

In the illustrated embodiment, two bumper pads 318 are shown on opposing lateral sides of the clamp 314-2. The bumper pads 318 may be removably secured to the outer surface of the clamp 314-2 for contact with the inner surface of a collar. In other embodiments, the bumper pads 318 may permanently secured to the clamp 314-2 using an adhesive, weld, or other mechanism. In at least some embodiments, the bumper pads 318-2 may be integrally formed with the body of the clamp 314-2, and thereby also permanently secured thereto.

Figure 4:
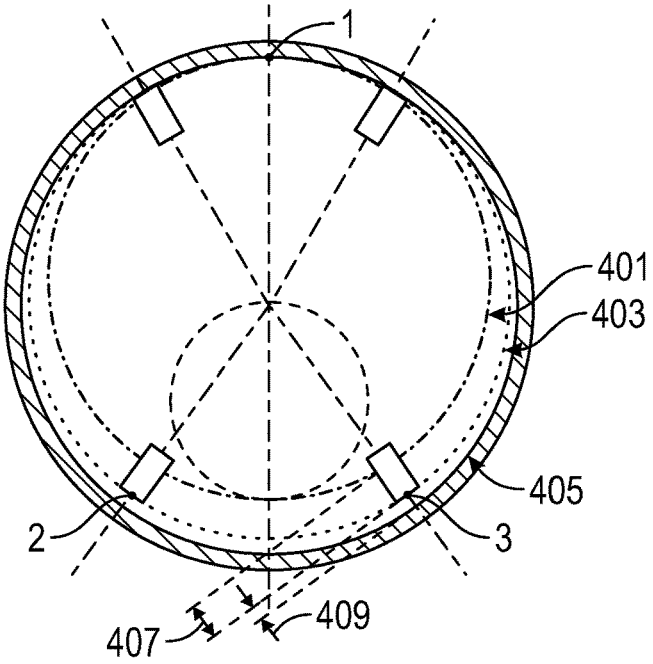
FIG. 4 is a schematic view of a support of a component using a three-point support, according to some embodiments of the present disclosure.

The bumper pads 318 may have a position that is fixed in any one or more of an axial, radial, or circumferential direction. The thickness may also be fixed. In other embodiments, the bumper pads 318 are adjustable in one or more directions. For instance, a method of embodiments of the present disclosure may include adjusting the radial position of the bumper pads. This may be done in any suitable manner, including by changing the bumper pad thickness (compression, expansion, replacement), or the position itself of the bumper pad (moving radially inward or outward). In some embodiments, adjusting the bumper pad radial position—and the amount of adjustment—can be critical to changing the shock and vibration experienced by the tool. In FIG. 3-2, the aim of adjusting the bumper pad thickness or radial position of the bumper pads 318 is to achieve a three-point support (or more) that is statically fully determined, as schematically shown in FIG. 4. FIG. 4 shows three-point support at points 1, 2, and 3, and also shows the difference in effective diameters. Diameter 401 represents the diameter of the chassis 302, diameter 403 represents the diameter of the bumper pads 318, and diameter 405 represents the internal diameter of the collar.

In the context of FIG. 3-2, the three points of contact shown in FIG. 4 are the top of the chassis (point 1) and the position 180° from the clamp 314-2, and the two bumper pads 318 (points 2 and 3). Using the bumper pads 318, a gap between the chassis 302 and a collar (e.g., collar 104 of FIG. 1-1) can be reduced relative to the as-manufactured size of the chassis and collar. The gap size limit is then given by the practicalities of the chassis loading process (i.e. better alignment may be needed and a tighter chassis may be more difficult to load. In FIG. 4, the difference in the gap is illustrated as length 407 represents the gap when the chassis 302 alone is fitted in the collar, and the reduced length 409 illustrates the gap when the radially elevated bumper pads 318 are installed.

Figures 1, 5:
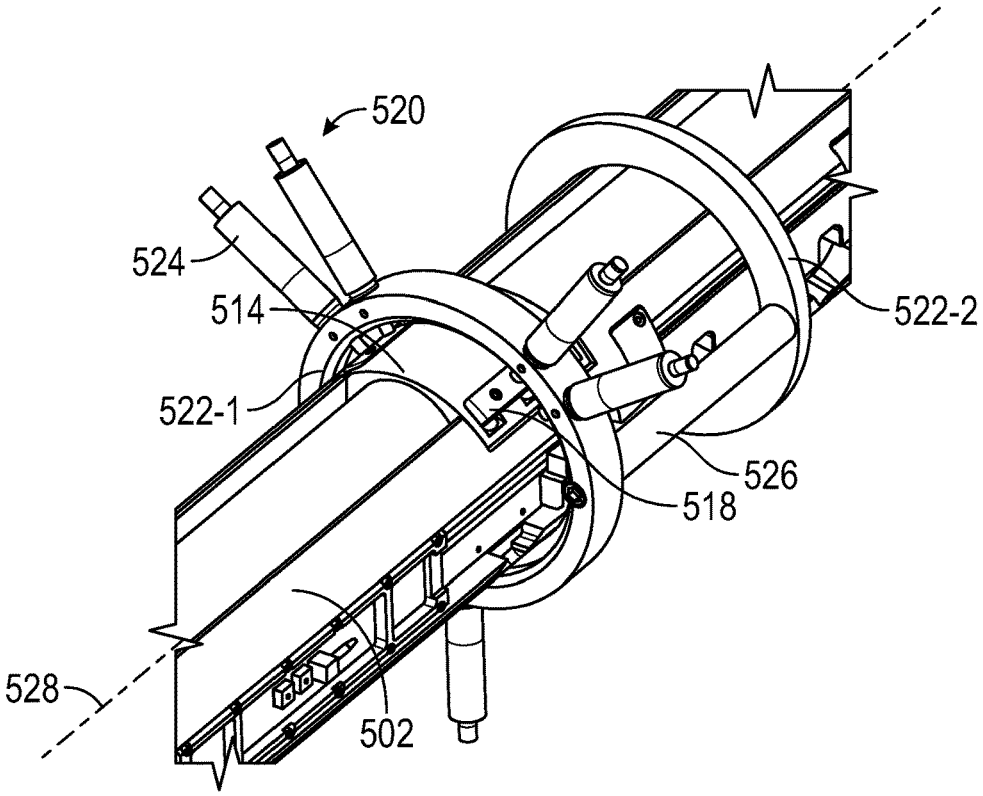
Figures 2, 5:
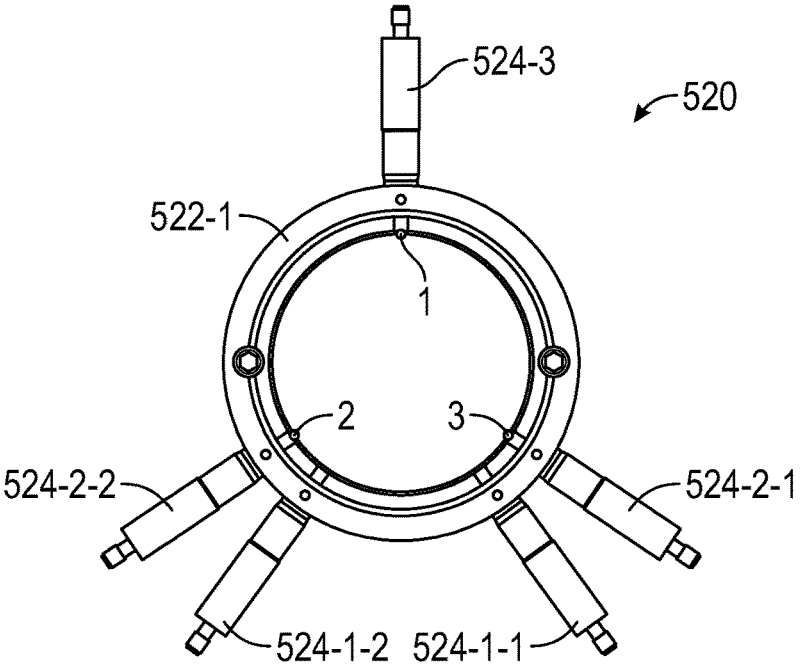

The radial position or bumper thickness can be measured using a ring gauge 520, as shown in FIGS. 5-1 and 5-2. The illustrated ring gauge 520 includes a lead ring 522-1 with micrometer heads 524 arranged at various angular positions. A follower ring 522-2 of this embodiment is attached to the lead ring 522-1 using one or more standoff rods 526 (two are shown). The follower ring 522-2 may be used to ensure squareness of the lead ring 522-1 with the axis 528 of the chassis 502. Each micrometer head 524 can be calibrated beforehand against a disc with a precisely known diameter. Then, the ring gauge 520 is placed on the chassis 502, and micrometers 524-2-1, 524-2-3 are used to (i) centralize the ring gauge 520 on the chassis 502 and (ii) ensure that the ring gauge 520 is touching point 1 (the first point according to the three-point support principle). Then, micrometers 524-1-1, 524-1-2 are used to measure the depth of the bumper pad pocket on the flow tube clamp 514, and the thickness for the bumper pad(s) 518 is calculated in order to achieve the desired effective OD of the chassis 502 (diameter 403 in FIG. 4).

Based on the measurements from the ring gauge 520, the bumper pads 518 may be adjusted. For instance, the bumper pads 518 may be ground or milled to size, supported with an appropriate number and size of shims, moved along a ramp, or otherwise expanded, compressed, or moved. In some embodiments, a gap of 50-100 microns between the surface of the bumper pad 518 and the collar ID (i.e., gap 409 of FIG. 4) may be used to facilitate the collar loading and to account for any uncertainties in the measurement and calibration process. The gap could, however, even be reduced further, particularly of more precise measurements or an insertion method with increased alignment is available.

Figures 1, 6:
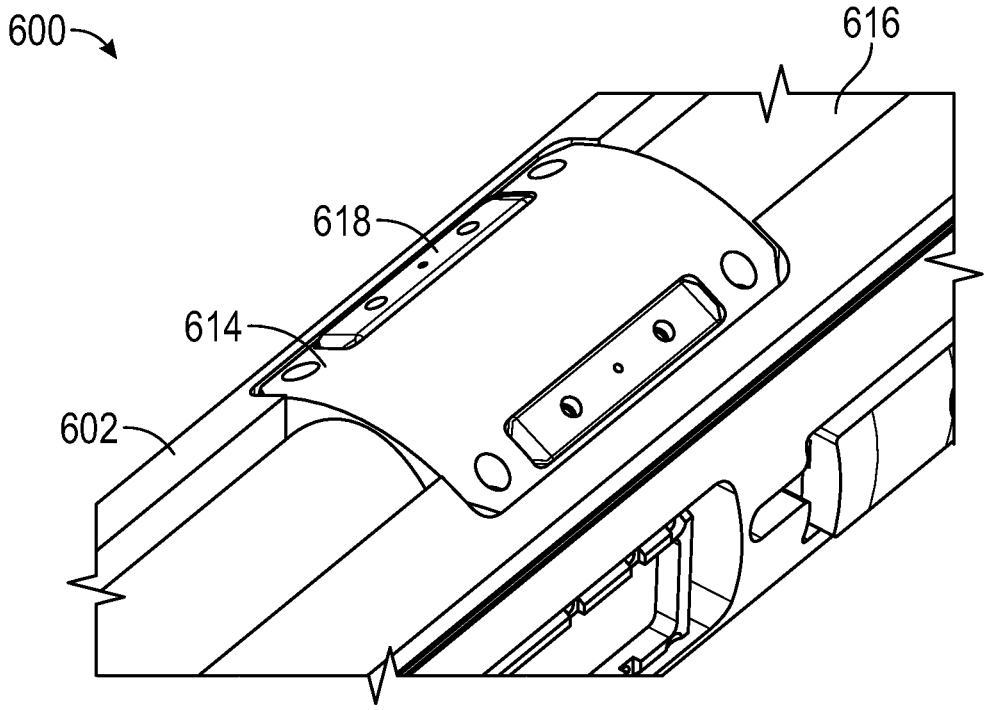
Figures 2, 6:
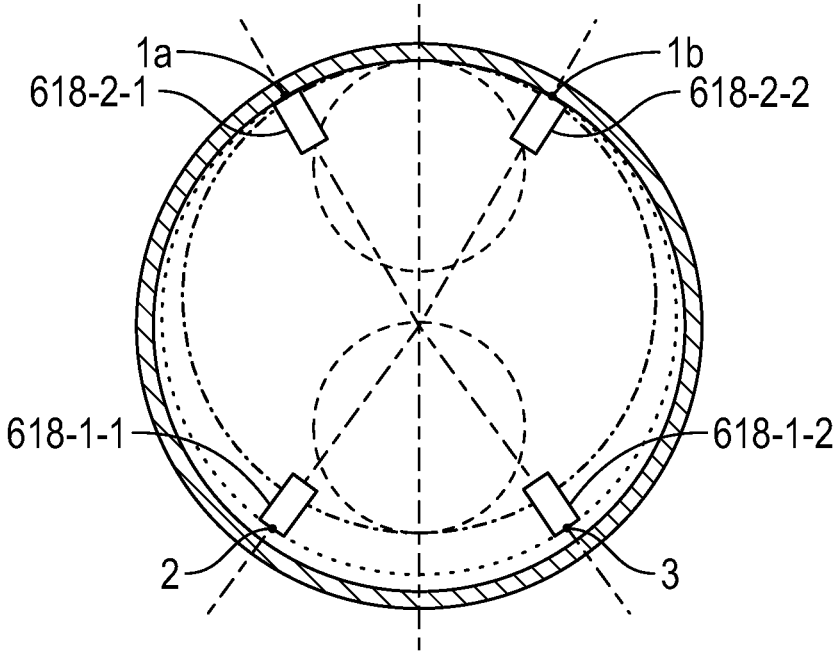

The methodology of some embodiments of the present disclosure may include modifications to one or more areas of a tool. FIGS. 6-1, for instance, shows the modification of a clamp 614 holding another component 616. For instance, the component 616 may be a rod, tube, or other structure. By way of illustration, if the tool 600 is a downhole LWD tool, the component 616 could be pulse neutron generator (PNG). Very similar to the flow tube clamps, this clamp 614 can be modified by adding two pockets for holding bumper pads 618, although a single pocket extending circumferentially along the outer surface of the clamp 614 could be used in some embodiments. In at least some embodiments, in the area of the chassis 602 where the clamp 614 is positioned, support point 1 (see FIG. 4) may not exist. Instead, an elongated slot or other void may be formed in or defined by the chassis 602 or collar 604 opposite a flow tube clamp to make room for the PNG or other component. This area may be particularly sensitive as a large cutout for the PNG or other tool (upper dashed circle in FIGS. 6-2), along with the large cutout for the flow tube clamp (lower dashed circle in FIGS. 6-2) on the opposite side may otherwise cause the chassis 602 not to be well supported. Hence, this clamp 618 has been modified and can be used the same way as the modified flow tube clamps (e.g., clamps 314-2, 514), and may be used in the same tool as the flow tube clamps, or even at a position axially aligned with a flow tube clamp.

In FIG. 6-2, two bumper pads 618-2-1, 618-2-2 in the modified clamp 614 provide a replacement support points 1*a* and 1*b* in lieu of point 1, while two bumper pads 618-1-1, 618-1-2 of a flow tube clamp provide supports 2 and 3. Hence, strictly speaking, this area provides a four-point support.

Figures 1, 7:
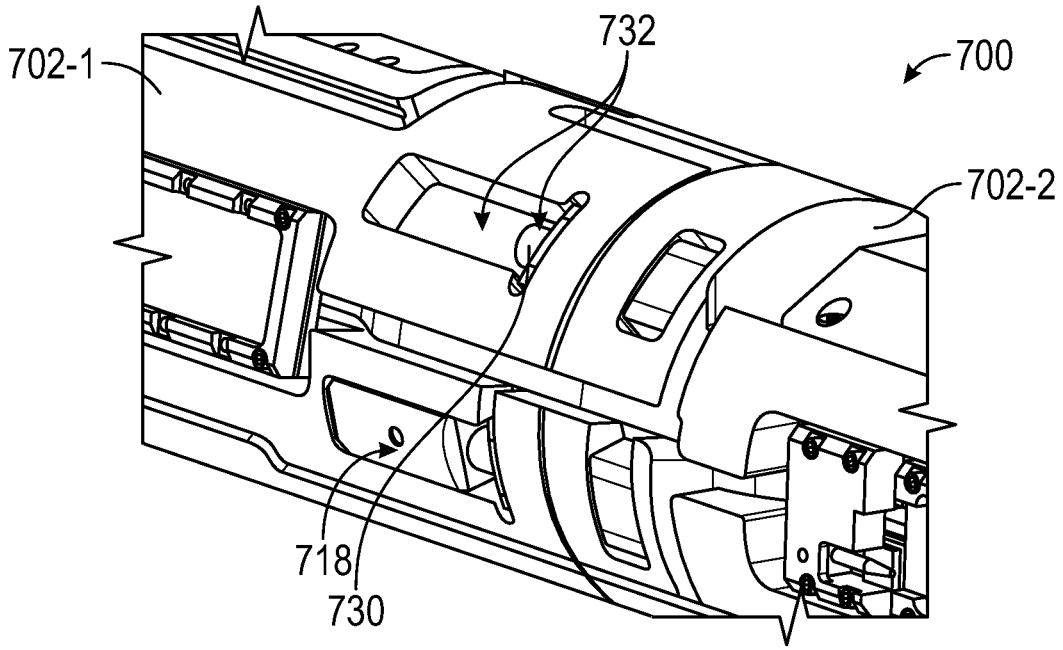
Figures 2, 7:
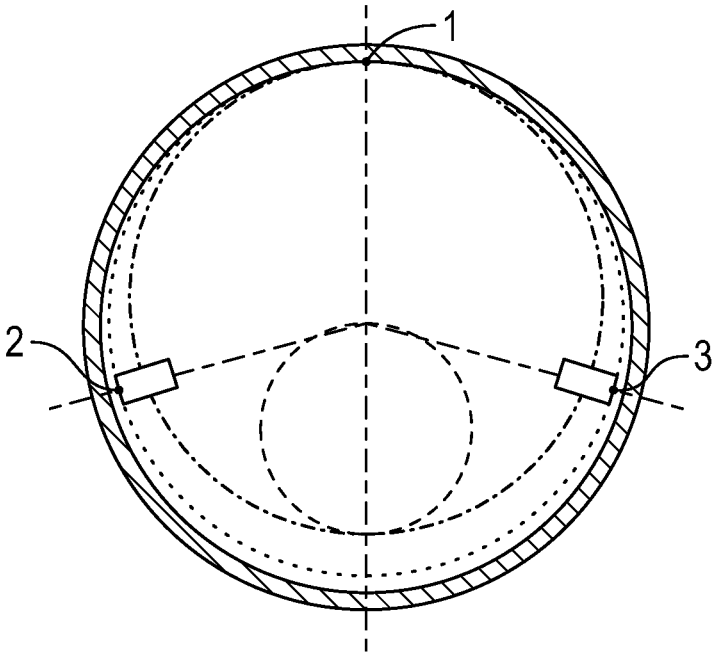

According to the same or other embodiments, an additional or alternative area that can be supported in an analogous way is a chassis joint. For instance, two portions 702-1, 702-2 of a chassis of FIG. 7-1 may be joined by 2, 3, 4, 5, or more bolts or other fasteners 730. In some embodiments, a tool 700 may be particularly prone to damage or harsh shocks or vibrations in an area at or near the joint between the two components 702-1, 702-2 of the chassis. Analyzing the tool design in accordance with the methodology of embodiments of the present disclosure also reveals an opportunity to provide increased support for the chassis in the joint area. For instance, in order to insert the bolts 730, large pockets 732 are formed as shown in FIG. 7-1. In this embodiment, these pockets 732 are re-used and fitted with bumper blocks 718, which will then act as another three or more-point support as shown in FIG. 7-2. The blocks 718 are sized and adjusted using any suitable method, including the same method described previously (i.e., ring gauge with micrometers and moving or re-sizing the blocks 718).

Another or alternative aspect of the present disclosure may be to bring the internal component (e.g., chassis) and external component (e.g., collar) into contact via the force of a stiff spring or other biasing member. According to some embodiments of the present disclosure, an alignment key or other alignment feature may be used in connection with the downhole tool, and the alignment key may provide an opportunity for supporting the chassis by reducing the gap with the collar. The original function of an alignment key in some tools is to provide angular alignment between the chassis and the collar during assembly. This alignment may be desirable as certain features on the collar and on the chassis are connected via cables or wires (e.g., resistivity antennas, communication channels, power supplies, etc.).

Figure 8:
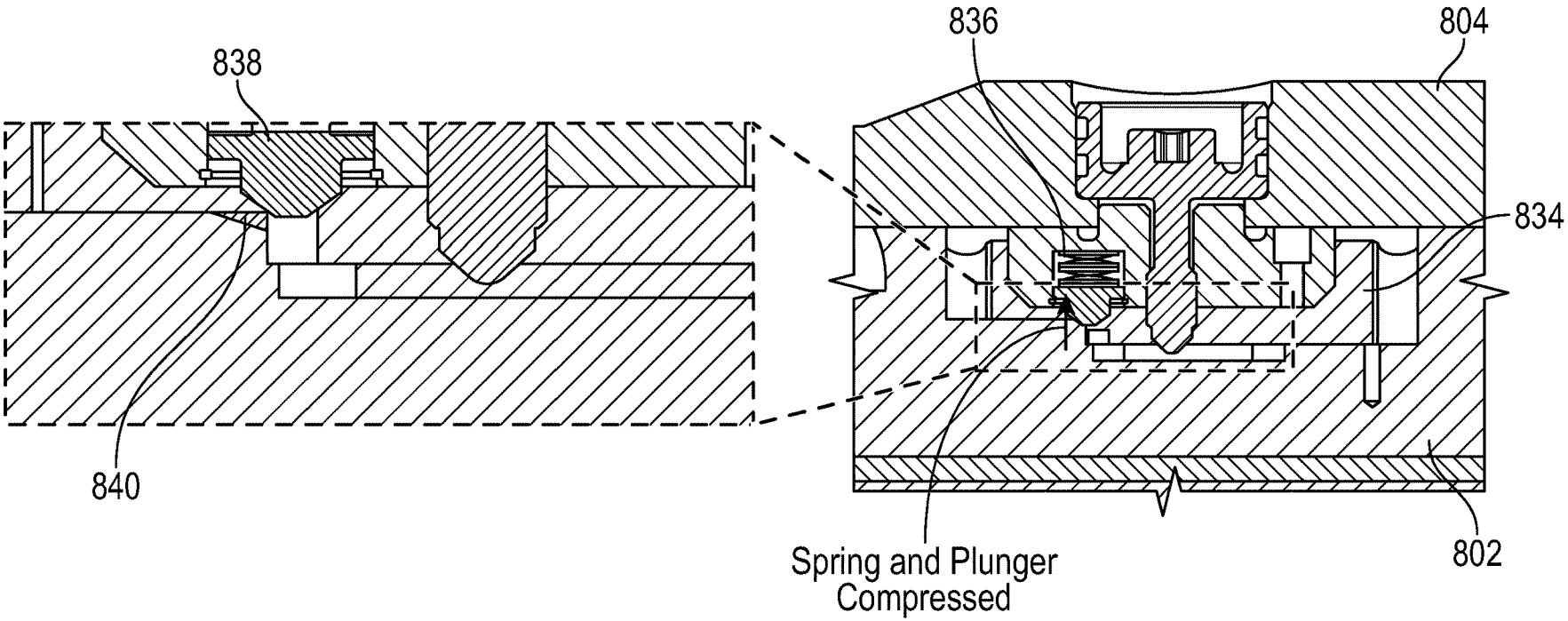
FIG. 8 is a cross-sectional view of an alignment key, along with a detailed view of a portion of the alignment key and a coupled chassis, according to some embodiments of the present disclosure.

FIG. 8 is a cross-sectional view of an alignment key 834 using resilient members 836 (e.g., Belleville springs). In FIG. 8, a modification to the alignment key 834 is shown in accordance with embodiments of the present disclosure. For instance, a spring loaded plunger 838 has been added to the alignment key design, and a small ramp 840 has been added to the edge of the pocket in the chassis 802. Upon chassis insertion, the spring loaded plunger 838 will slide up the ramp 840 and compress the springs 836 and therefore exert a force which will press the chassis 802 against the ID of the collar 804, thus restricting and potentially preventing the chassis 802 from moving inside the collar 804. A feature of this particular embodiment is that the springs 836 can take up any dimensional variability of the surrounding parts that result from manufacturing tolerances.

Figure 9:
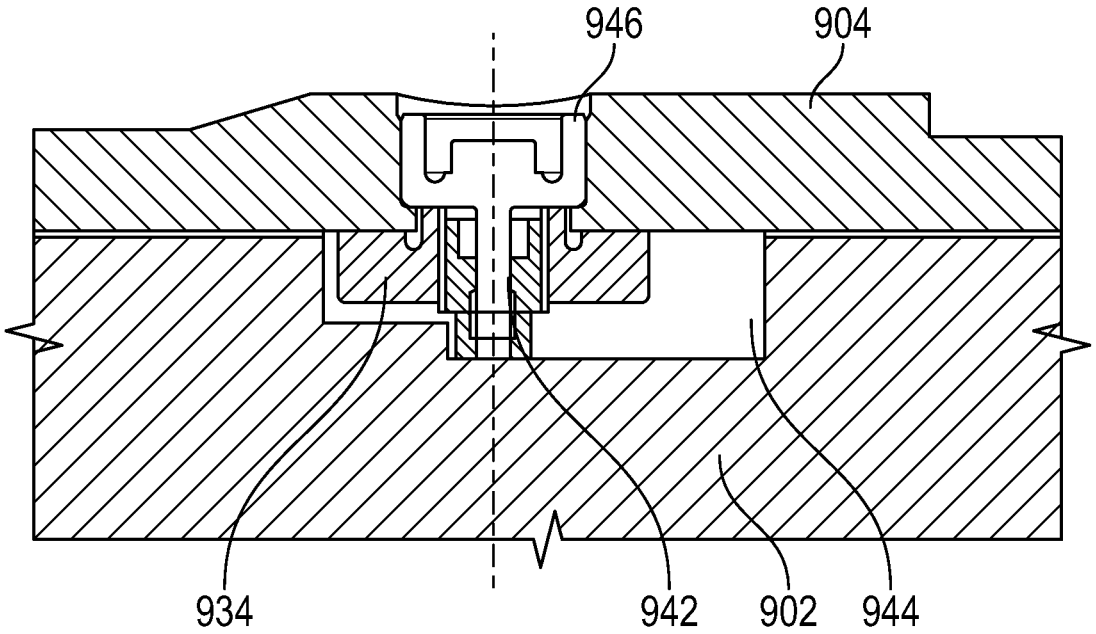
FIG. 9 is a cross-sectional view of another embodiment of an alignment key that includes an intermediate set screw.

Another embodiment that locks the chassis 902 against the collar 904 using the existing alignment key 934 is to introduce an intermediate set screw 942 or other threaded component, which engages in a thru-thread in the alignment key 934, as shown in FIG. 9. In this illustrated design, the intermediate set screw 942 is assembled once the chassis 902 is fully inserted into the collar 904, and the intermediate set screw 942 is then tightened. For instance, the intermediate set screw 942 may have a recess to receive a hexagonal, star, or other shaped key.

In some embodiments, tightening the intermediate set screw 942, causes the body of the alignment key 934 to move upwards against the internal diameter (ID) of the collar 904 as the intermediate set screw 942 in turn pushes off the bottom of a pocket 944 in the chassis 902. This can then create a force that potentially locks or fastens the chassis 902 into the collar 904 and restricts and potentially eliminates any relative movement. A threaded hole in the center of the intermediate set screw 942 is optionally used to accept a port plug 944, which is a standard port plug in some embodiments, although a custom or proprietary port plug is used in other embodiments. One feature of the embodiment shown and described relative to FIG. 9 is that no or few modifications can be made to the collar 904 or chassis 902, and only minor changes to inexpensive parts may be used.

Figure 10:
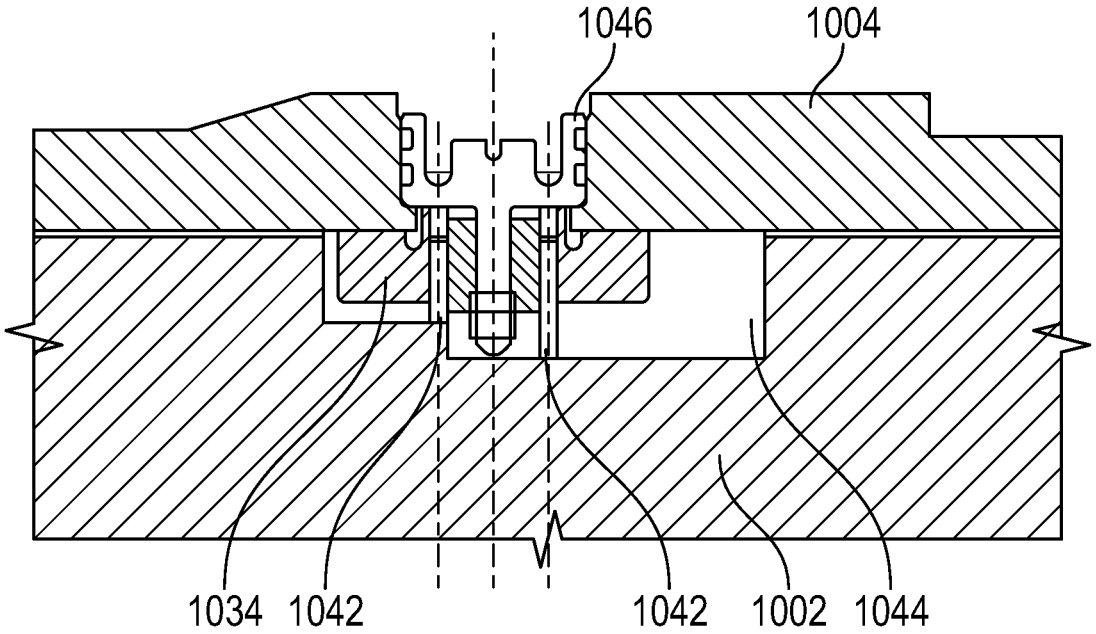
FIG. 10 is a cross-sectional view of still another embodiment of an alignment key that includes multiple set screws.

FIG. 10 illustrates another embodiment of a method or device for modifying an existing alignment key 1034. In the illustrated embodiment, multiple set screws 1042 are used within the thread for the port plug 1046, rather than a single and potentially larger intermediate set screw (compare to FIG. 9).

In the illustrated embodiment, the set screws 1042 can be tightened individually and at separate times, and their clamping forces (e.g., by pushing against the wall of the pocket 1044 in the chassis 1002 and causing the alignment key 1034 to push against the ID of the collar 104) will sum to provide an increased locking force between the chassis 1002 and collar 1004. The port plug 1046 can then be placed, threaded, or otherwise assembled in an original threaded hole.

While FIGS. 9 and 10 illustrate some example embodiments for modifying an alignment key using threaded components, one skilled in the art will appreciate other alternatives are possible and which fall under the scope of the present disclosure.

Figure 11:
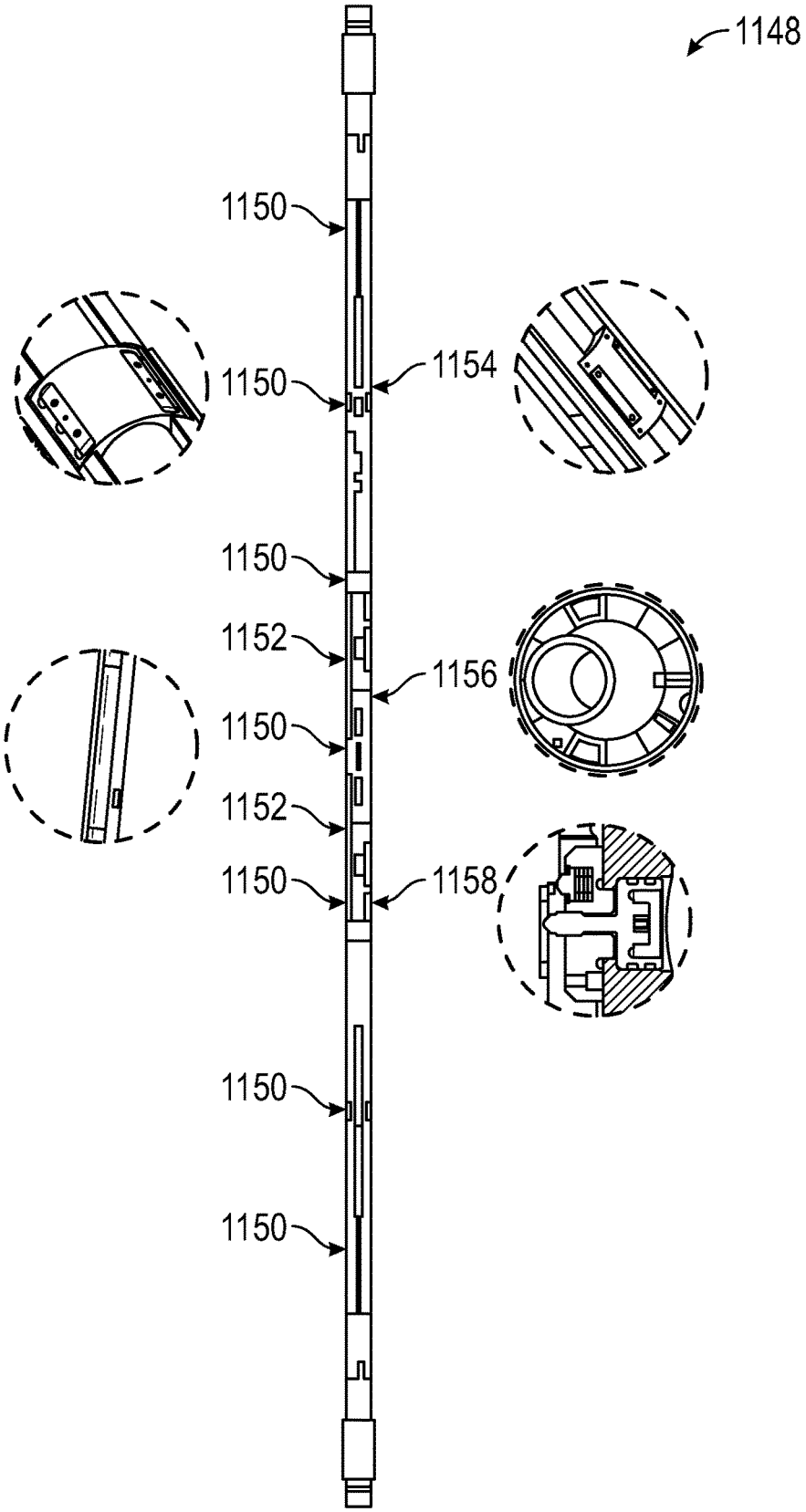
FIG. 11 is a side view of a drill string including various stabilization assemblies, according to embodiments of the present disclosure.

Embodiments of the present disclosure may be used individually or in any of various combinations in order to stabilize one or more locations along a tool, such as a drill string. FIG. 11, for instance, illustrates an example downhole tool 1148 that may experience lateral, axial, torsional, or other vibrations while performing a downhole operation. In order to reduce shock and vibration to the downhole tool, multiple stabilization assemblies may be incorporated. For instance, in some embodiments, the downhole tool includes one or more flow tube and one or more clamps 1150 may be used to secure the flow tubes. In at least some embodiments, the flow tube clamp 1150 may have a design as described herein (e.g., see FIG. 3-1).

In the same or other embodiments, the downhole tool 1148 may include one or more flow tube clamps 1152 that also include bumper pads or other contact points to create three or more point support. Other or further stabilization features, including further flow tube clamps 1154 of other designs or function (see FIGS. 6-1 and 6.2), stabilization assemblies 1156 at joints (see FIGS. 7-1 and 7-2), alignment key stabilization features 1158 (see FIGS. 8-10), other features, or combinations of the foregoing may be used in a drilling, remedial, production, wireline, exploration, or other type of downhole tool 1148.

Figure 12:
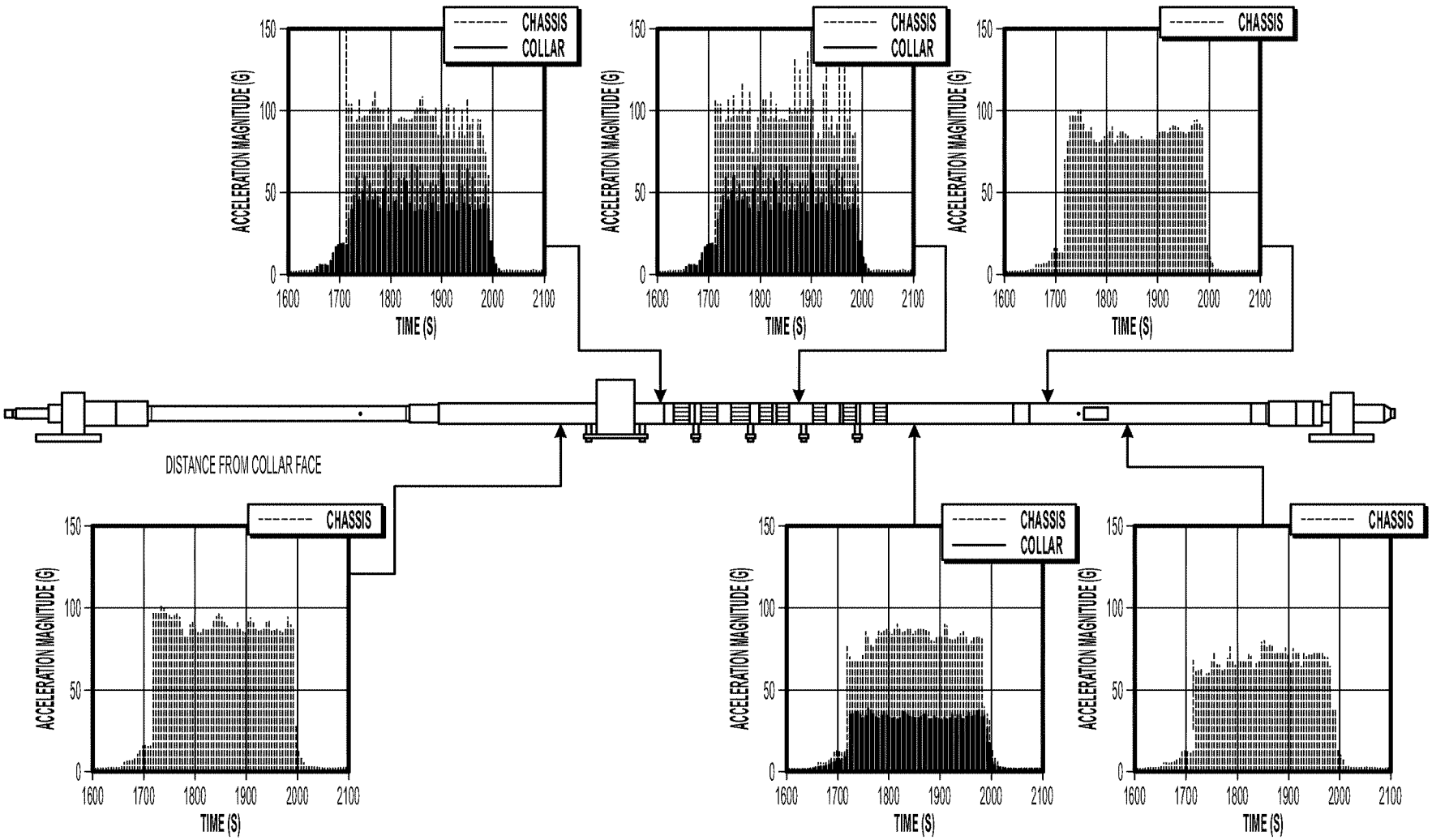
FIG. 12 is a view of a drilling BHA along with shock levels, according to an embodiment of the present disclosure.
Figure 13:
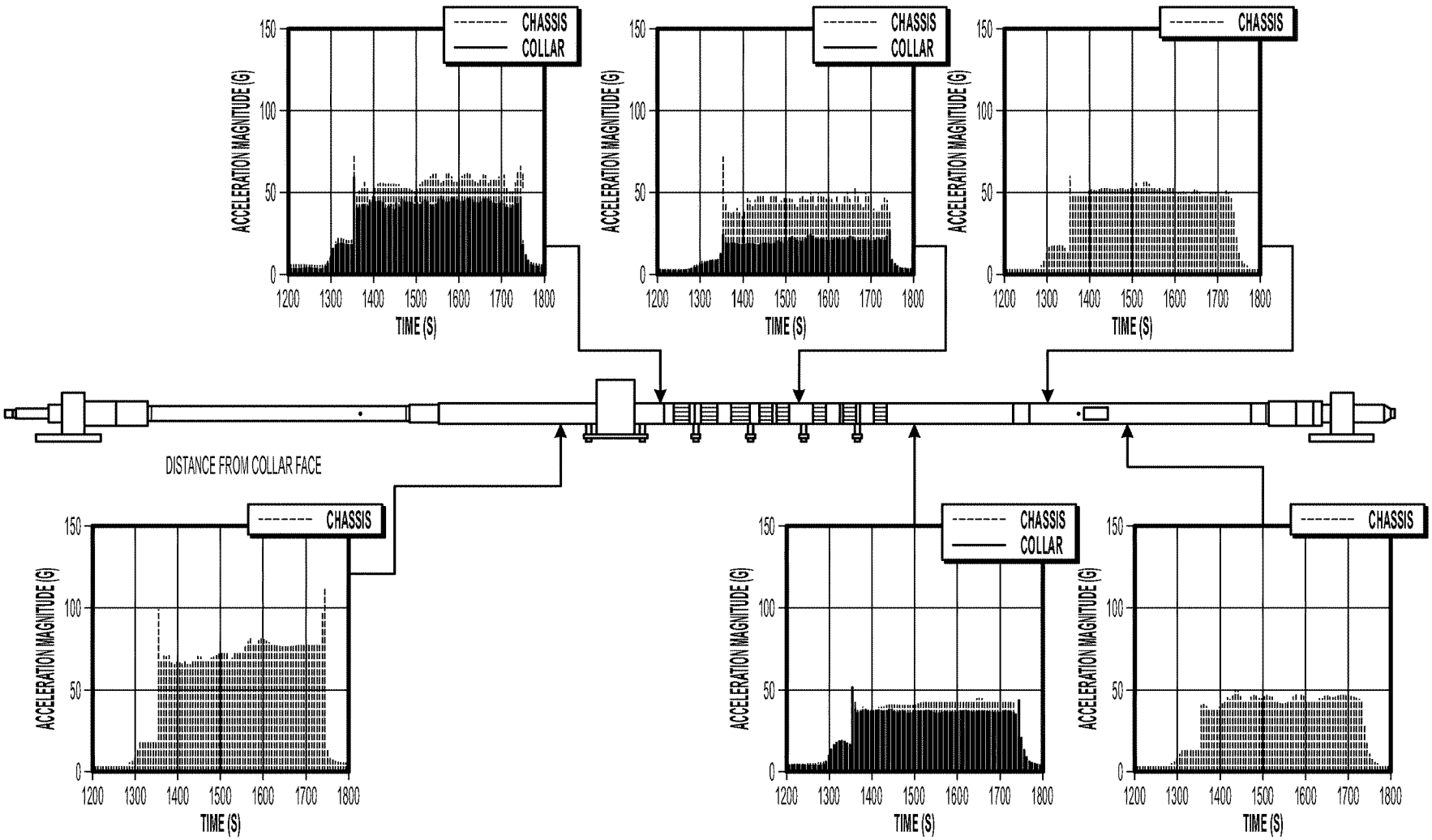
FIG. 13 is a profile view of the drilling BHA of FIG. 11 after application of a shock and vibration reduction kit, along with illustrations of shock levels, according to another embodiment of the present disclosure.

Tests have been conducted that show the effectiveness of embodiments of the present disclosure. A highly instrumented drilling tool was produced and used to quantify the difference between a standard commercial tool, and the same tool equipped with a shock reduction kit including embodiments of the present disclosure. FIGS. 12 and 13 shows a comparison between the commercial tool (FIG. 12) and the same tool equipped with the shock reduction kit (FIG. 13). Each plot shows the same scale of time signal of shocks (i.e., in 'g') versus time. Both tests have been conducted under the same parameters and conditions, and the improvements in the shock response of the tool with the smaller gap resulting from the shock reduction kit is very visible. Such improvements are on both the shocks on the chassis, but also on the collar. It appears that the overall tool response is much more "quiet" when the effective internal gap is reduced, which could have an influence on the overall reliability of the tool.

It will be appreciated in view of the disclosure herein that there could be a number of variations to the tools, methods, and kids provided, and to the tooling and replacement parts (e.g., bumpers, clamps, etc.) that may be used. For instance, a precision ring or tube may be used in connection with or in lieu of a ring gauge with micrometer heads. In another embodiment, a feeler gauge may be used instead of the ring gauge with micrometer heads. Such embodiments could simplify adjustment and installation methods to make and use the tools increasingly user friendly and deployable in field locations.

In some embodiments, bumper pads may be used as described herein. The bumper pads may have customized sizes: however, in other embodiments bumper pads may have a standard size and a system of shims or the like may be used to achieve a certain effective chassis outer diameter. Additionally, different materials may be used for the bumper pads. Polymers such as PTFE, PEEK, UHMWPE, or the like may be used, although non-polymers may also or alternatively be used. For instance, a metal such as aluminium-bronze, titanium, tungsten carbide, or the like may be used. Besides minimizing the gap, material selection could be used to add damping effects to the system. Also, so-called sandwich blocks that include combinations of materials (e.g., metal and rubber/plastic/polymer/dampening material) could be used. There could also be sizing changes to potentially improve bumper pads even closer to the collar ID.

Additionally, different bumper blocks or bumper block kits could be made which are effective at different temperatures, pressures, sizes, for different tools, etc., depending on the job planning. Such bumpers may also be made from a material allowing for a certain amount of thermal expansion so that the heat downhole will help make the gap smaller. Bumper pads, including those with dampening effect, could be added to support point 1 in order to achieve an all-around "dampening suspension" of the chassis within the collar. Once the bumpers on a chassis are sized appropriately, the bumper size and location on the tool could further be recorded, which would make future servicing easier in case the bumpers get worn. Chasses and collars could also be kept together as pairs so that gap size is a known value.

With example alignment keys, further variations could include a combination of a threaded and wedged locking/engagement mechanism, a threaded-only locking/engagement mechanism, or other engagement mechanisms. It is also contemplated that other locations of a downhole tool can include internal stabilization features, based on the degree of chassis modifications and space availability, so that spring suspensions, three-contact support, locking, dampening suspensions, or the like could be provided.

Figure 14:
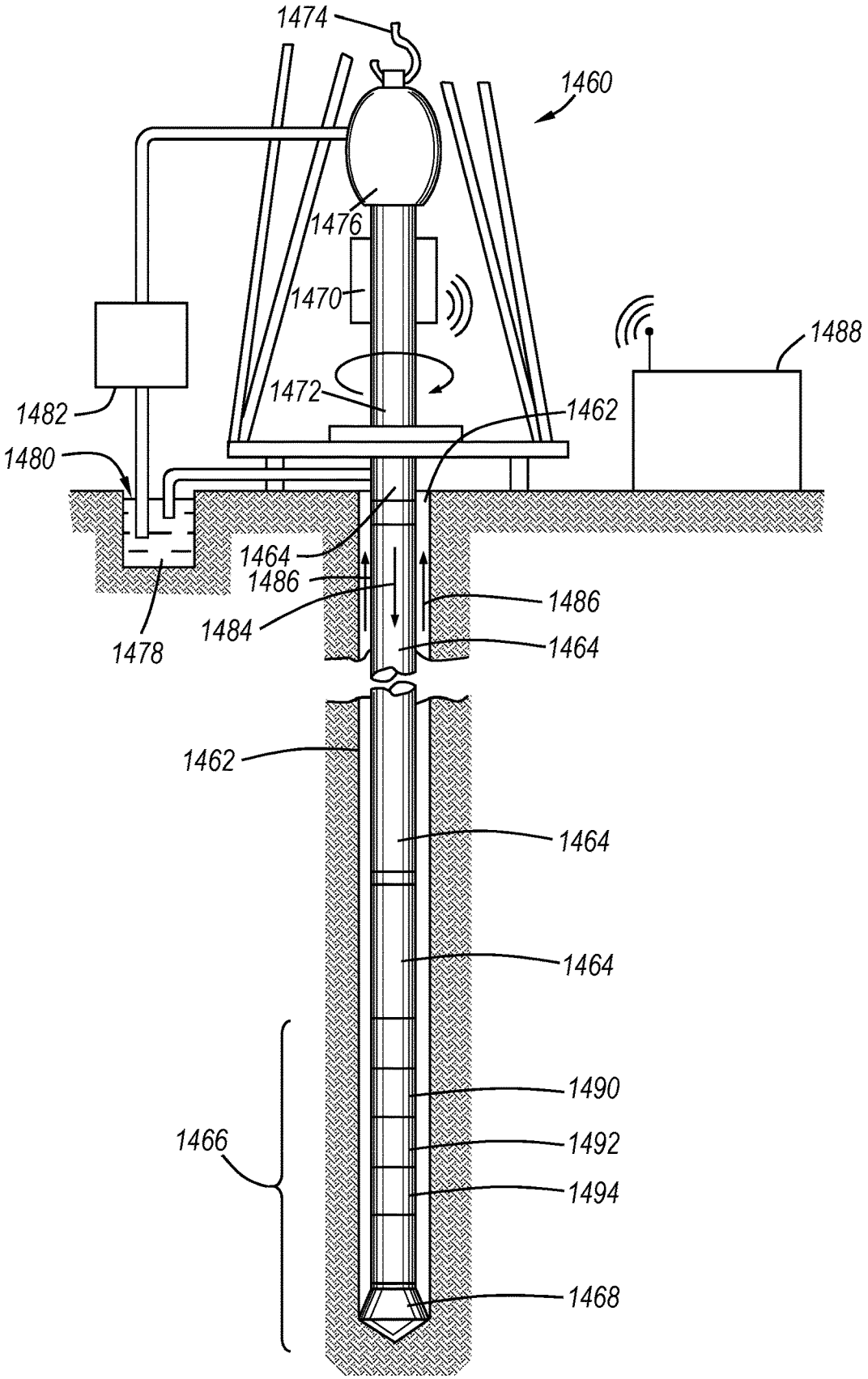
FIG. 14 is a schematic view of a drilling system for operation at a wellsite to drill a wellbore through an earth formation.

Embodiments of the present disclosure can be used in a number of industries and applications. An example of such application is in a downhole environment when exploring for hydrocarbons or other natural resources, drilling a wellbore, or producing resources from the wellbore. By way of illustration only. FIG. 14 illustrates an example drilling system 1460 for operation at a wellsite to drill a wellbore through an earth formation. The wellsite can be located offshore or onshore. In this system, a wellbore 1462 is formed in subsurface formations by rotary drilling, and can include directional drilling systems, pilot hole drilling systems, casing drilling systems, and the like.

In the drilling system 1460, a drillstring 1464 is suspended within the borehole 1462 and has a bottomhole assembly 1466, which includes a drill bit 1468 at its lower end. The surface system of the drilling system 1460 includes a platform and derrick assembly positioned over the borehole 1462 and including a top drive 1470, kelly 1472, hook 1474, and rotary swivel 1476. The drillstring 1464 is rotated by the top drive 1470 which engages the kelly 1472 at the upper end of the drillstring 1464. The drillstring 1464 is suspended from the hook 1474, attached to a traveling block (not shown), through the kelly 1472 and the rotary swivel 1476, which permits rotation of the drillstring 1464 relative to the hook 1474. A rotary table system could be used in other embodiments to rotate the drillstring 1464 in the wellbore and thereby rotate the drill bit 1468 against a face of the earth formation at the bottom of the wellbore.

The surface system can further include drilling fluid or mud 1478 stored in a pit 1480 formed at the well site. A pump 1482 delivers the drilling fluid 1478 to the interior of the drillstring 1464 via a port in the swivel 1476, causing the drilling fluid 1478 to flow downwardly through the drillstring 1464 as indicated by the directional arrow 1484. The drilling fluid exits the drillstring 1464 via ports in the drill bit 1468, and then circulates upwardly through the annulus region between the outside of the drillstring 1464 and the wall of the wellbore 1462, as indicated by the directional arrows 1486. In this manner, the drilling fluid 1478 lubricates the drill bit 1468, cools the drill bit 1468, and carries formation cuttings up to the surface as it is returned to the pit 1480 for recirculation.

A control unit 1488 may be used to control the top drive 1470 or other drive system. The top drive 1470 may rotate the drillstring 1464 at a rotation speed to produce desired drilling parameters. By way of example, the speed of rotation of the drillstring 1464 may be determined to optimize drilling speed (i.e., rate of penetration), to reduce drill bit wear, according to properties of the earth formation, or the like.

The bottomhole assembly 1466 may include a logging-while-drilling (LWD) module 1490, a measuring-while-drilling (MWD) module 1492, a rotary-steerable system or motor 1494, and drill bit 1468.

The MWD module 1492 may be housed in a special type of drill collar, and can contain one or more types devices for measuring characteristics of the drillstring 1464, the drill bit 1468, or other portions of the BHA 1466. The MWD module 1492 may further include an apparatus (not shown) for generating electrical power to the downhole system. This may include a mud turbine generator powered by the flow of the drilling fluid 1478, although other power (e.g., battery) systems may be employed. The MWD module 1492 may include one or more of the following types of measuring devices or other sensors: a weight-on-bit sensor: a torque sensor: a vibration and/or shock sensor (e.g., an accelerometer): a stick-slip sensor or inference device: a direction sensor: a rotational speed sensor (e.g., a gyroscope or tachometer); a speed sensor: or an inclination sensor.

The LWD module 1490 may also be housed in a special type of drill collar, and can contain one or a plurality of types of logging tools. It will also be understood that more than one LWD module 1490 and/or MWD module 1492 can be employed. The LWD module 1490 may include capabilities for measuring, processing, and storing information, as well as for communicating with the surface equipment. The LWD module 1490 may include a fluid sampling device. Typical LWD modules 1490 include, for example, natural gamma ray, spectral density, neutron density, inductive and galvanic resistivity, acoustic velocity, acoustic caliper, downhole pressure, and the like. Formations having recoverable hydrocarbons typically include certain physical properties, for example, resistivity, porosity (density), and acoustic velocity values in a certain range.

The BHA 1466, including the LWD module 1490, MWD module 1492, and rotary steerable 1494 can be subjected to harsh downhole conditions while drilling or performing another downhole operation. These external conditions can produce in vibration along the BHA 1466 and the drillstring 1464. Additionally, the design of the BHA 1466 and drillstring 1464 itself can affect the vibrations that are felt. Vibrations may include both external vibrations (e.g., vibrations measured on the outside of the BHA 1466 or drillstring 1464), or internal vibrations (e.g., vibrations measure don the inside of the BHA 1466 or drillstring 1464).

As discussed herein, when a flow tube, rod, or other tool is used within a tool (e.g., within the drillstring 1464, BHA 1466, LWD module 1490, MWD module 1492, or rotary steerable 1494), such a tool itself cause or impact the vibrational susceptibility of the drillstring 1464. A chassis within the drillstring 1464, BHA 1466, LWD module 1490, MWD module 1492, or rotary steerable 1494 and which contains or is coupled to another internal tool may help control the vibration. Embodiments of the present disclosure can include further use of methods, systems, tools, and kits to further control vibration by affecting the gap between the chassis and the collar of the BHA 1466, LWD module 1490, MWD module 1492, rotary steerable 1494, or other components, maintaining contact between the chassis and the internal surface of such components using three or more points of contact, and the like. In some embodiments, the vibration that is controlled includes internal vibration of a drill string or BHA where internal components vibrate relative to an outer collar, such as where one or more internal components are not coaxial or are not mass balanced.

The embodiments of stabilization or vibration dampening features have been primarily described with reference to wellbore, downhole operations such as drilling: however, kits, methods, systems, and assemblies of the present disclosure may be used in other applications within a wellbore or other industries. In other embodiments, stabilization features according to the present disclosure may be used outside a wellbore or other downhole environment used for the exploration or production of natural resources. For instance, stabilization features of the present disclosure may be used in a borehole used for placement of utility lines. Accordingly, the terms "wellbore." "borehole" and the like should not be interpreted to limit tools, systems, assemblies, or methods of the present disclosure to any particular industry, field, or environment. In further examples, a manufacturing, research, or other application that includes internal flow tubes or chasses within an outer tube or collar, or joints between tubes, and which suffer from shock and vibration may include embodiments of the present disclosure.

Although one or more specific embodiments of the present disclosure are described herein, these described embodiments are examples of the presently disclosed techniques. Additionally, in an effort to provide a concise description of these embodiments, not all features of an actual embodiment may be described in the specification.

The articles "a," "an," and "the" are intended to mean that there are one or more of the elements in the preceding descriptions. It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process in the related industry, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately." "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A jointed tool, comprising:

a first chassis portion;

a second chassis portion coupled to the first chassis portion at a joint;

a collar positioned around the first and second chassis portions;

one or more pockets in the first chassis portion;

one or more fasteners within the one or more pockets and which couple the first chassis portion to the second chassis portion; and one or more bumper pads in the one or more pockets and which extend radially beyond an outer surface of the first chassis portion, wherein the first and second chassis portions and the one or more bumper pads provide three or more points of support between the collar and the first and second chassis portions.

2. The jointed tool of claim 1, further comprising:

a tube or rod at least partially within the first chassis portion, the second chassis portion, or the first and second chassis portions.

3. The jointed tool of claim 1, further comprising:

an alignment feature that angularly aligns the first and second chassis portions and the collar and which at least partially fills a gap between (i) the outer surface of the first chassis portion and an outer surface of the second chassis portion and (ii) an inner surface of the collar.

4. The jointed tool of claim 3, wherein the alignment feature includes one or more biasing members that biases at least a portion of the outer surface of at least one of the first chassis portion or the second chassis portion into contact with the inner surface of the collar.

5. The jointed tool of claim 4, further comprising:

a plunger that is radially movable relative to the at least one of the first chassis portion or the second chassis portion, which movement is configured to compress the one or more biasing members and press the at least one of the first chassis portion or the second chassis portion against the collar.

6. The jointed tool of claim 3, further comprising one or more threaded components that are movable in a radially inward direction relative to at least one of the first chassis portion or the second chassis portion, which movement is configured to contact a pocket wall and thereby press the alignment feature against the inner surface of the collar.

7. The jointed tool of claim 6, an opening being defined in the one or more threaded components or between two or more threaded components, and the jointed tool further comprising:

a plug positioned a least partially within the collar and the opening.

* * * * *